US005426901A

United States Patent [19]

Indracek

[11] Patent Number: 5,426,901

[45] Date of Patent: Jun. 27, 1995

[54] MOLDING ASSEMBLY

[76] Inventor: Jaroslav Indracek, P.O. Box 523, McClellanville, S.C. 29458

[21] Appl. No.: 112,796

[22] Filed: Aug. 27, 1993

[51] Int. Cl.[6] ..... E04B 5/00

[52] U.S. Cl. ..... 52/288.1

[58] Field of Search ..... 52/287.1, 290, 220.1, 52/288.1, 242, 718.02, 287; 174/48

[56] References Cited

U.S. PATENT DOCUMENTS

| | | | |
|---|---|---|---|
| 903,079 | 11/1908 | Goddard | 52/718.02 |
| 908,858 | 1/1909 | Goddard | 52/718.02 |
| 981,937 | 1/1911 | Ohnstrand | 52/212 |
| 1,825,010 | 9/1931 | Murphy | 52/288.1 |
| 1,990,259 | 2/1935 | Walters | 52/242 |
| 2,981,988 | 5/1961 | Schweitzer | 52/288.1 |
| 3,302,350 | 12/1967 | Brown et al. | 52/287.1 |
| 3,742,668 | 7/1973 | Oliver | 52/288.1 |
| 3,805,471 | 4/1974 | De Schutter | 52/211 |
| 4,109,434 | 8/1978 | Katzin | 52/287.1 |
| 4,642,957 | 12/1987 | Edwards | 52/242 |
| 4,843,771 | 7/1989 | Chapman et al. | 52/718.05 |
| 5,001,877 | 3/1991 | Edwards | 52/288.1 |
| 5,179,811 | 1/1993 | Walker et al. | 52/287.1 |

*Primary Examiner*—James L. Ridgill, Jr.
*Attorney, Agent, or Firm*—Richard C. Litman

[57] ABSTRACT

A molding assembly which includes a length of molding, a pair of retainers, and a plurality of optional L-shaped brackets is disclosed. The molding assembly is for use in dressing up a junction or intersection between a wall and a ceiling and to provide an aesthetically pleasing appearance. The molding is shaped in the form of conventional crown molding having yieldable or deflecting securing members disposed at opposite ends. The yieldable securing members are formed to include a throat having a reduced area and an enlarged area. The throat is in open communication with an enlarged area. The retainers each include an inwardly and rearwardly directed hook which is frictionally engageable with a respective yieldable fastener. Successively arranged slots are disposed along the entire length of each retainer for receiving fasteners therethrough to secure the same to a mounting surface. The L-shaped brackets have a plurality of through bores passing therethrough. The molding assembly is used to mount the molding to both a wall and ceiling. When mounting the molding to both the wall and the ceiling, the L-shaped bracket is omitted. When mounting the molding to the wall spaced apart from the ceiling, or to the ceiling spaced apart from the wall, the L-shaped bracket is employed to retain the shape of the molding.

5 Claims, 4 Drawing Sheets

MOLDING ASSEMBLY

BACKGROUND OF THE INVENTION

1. Field of the Invention

The present invention relates to a molding assembly and, more particularly, to a crown molding assembly including an improved crown molding and means for installing the same.

2. Description of the Prior Art

It is commonly desirable to dress up a junction or intersection between vertical walls and a ceiling. The application of a decorative molding along the intersection of the walls and ceiling covers unsightly, unfinished gaps or defects and provides an aesthetically pleasing appearance. Primary concerns associated with the application of molding include minimizing labor expenses; striking a balance between types of materials used, material costs, and the ease by which the molding is installed; and the means in which the molding is fastened.

Skilled labor is required to apply trim and molding. However, even through the employment of skilled workers, installation of molding and trim may still be very time consuming and very expensive. There is a need for molding and trim which is relatively easy to install, thus requiring a reduction in installation time and, in turn, a reduction in labor cost. Several means have been devised for promoting the ease of installing molding. For example, the installation of wood molding often involves the application of a series of layers of separate and distinct pieces. Crown molding and baseboard trim alike are both generally applied in two or more layers. In an effort to conserve labor time and expense, it is known to form the various layers of molding into a single piece being of unitary construction, as is shown in U.S. Pat. No. 4,109,434, issued Aug. 29, 1978 to Lawrence F. Katzin. Katzin discloses a modular baseboard molding which includes a baseboard plank and shoe molding into a cooperatively associated unit allowing for the simultaneous cutting of the same.

In an effort to reduce not only labor costs but material costs as well, various materials have been employed in the construction of molding. Presently, the most common molding is of wood construction. However, wood molding is becoming quite expensive in comparison to synthetic molding. Further, synthetic molding generally requires little if any periodic maintenance in contrast to the periodic maintenance demanded by wood molding. Alternative materials, such as metals and plastics, are often used to fabricate structures representative of wood molding. Unlike wood molding, a problem is encountered with fixing the structures to the intersection of the walls and ceiling whereby substantially no evidence vestiges of the fastening devices are visible. For instance, molding formed of synthetics and metals generally require tacking or gluing. Tacks are generally unsightly and, though glue is for the most part not visible, it can be unreliable over a course of time, losing its adhesive properties and enabling the molding to become detached from the surface to which it is applied.

Various means for attaching molding, be it wood, metal, or synthetic, have been devised. One such fastening which has been contrived to secure molding is shown in U.S. Pat. No. 5,179,811, issued Jan. 19, 1983 to William H. Walker et al. Walker et al. discloses a decorative trimming system for installing crown mold, baseboard trim, and the like. The system includes an elongated mounting bracket adapted to be secured along room walls extending about the periphery. Each bracket includes a projecting tongue that extends along its length. Prefabricated corner pieces of molding are provided with grooves extending along their back sides for receiving the tongues projecting from the brackets. This molding system still requires the use of finishing nails which must be set and covered with a painter's putty.

The concealing of molding and trim fasteners altogether is also known to be the subject of prior art patents. For example, U.S. Pat. No. 4,642,957, issued Feb. 17, 1987 to Troy C. Edward, discloses a interior wall trim system for providing a decorative trim at the junction of interior wall partitions or at the junction of walls and ceiling. The system includes a molded vinyl channel shaped cap member for placement along the intersection. The cap members are releasably secured in position by spaced apart retainer plates which are formed with opposed standoff flanges which engage resiliently deflectable flanges of the cap members. Opposing reentrant flanges of the cap members forcibly engage the standoff flanges of the retainer members. A similar molding construction is disclosed in U.S. Pat. No. 3,302,350, issued Feb. 7, 1967 to Donald L. Brown et al. The molding construction includes an attachment member for attaching to the corners of adjoining building partitions. The attachment member includes a hooking protrusion and a snap joint respectively engageable with hook structure and a protrusion of a cover member for retaining the same.

Yet another molding system which facilitates concealing the molding fasteners is disclosed in U.S. Pat. No. 5,001,877, issued Mar. 26, 1991 to Troy C. Edwards. Edwards teaches a decorative wall and ceiling molding assembly for providing a decorative trim at ceiling-wall junctions. The assembly includes a hollow plastic molding having a decorative panel which is hinged to provide an openable and recloseable feature, and means for holding the molding in a closed position. The molding has a flat ceiling contacting surface and a flat wall contacting surface which are fixed to both surfaces by means of fasteners. Upon fixing the trim to both surfaces, the trim is closed and held in the closed position by the holding means to conceal the fasteners and the contacting surfaces.

With the increasing costs of labor and materials, there exists a ongoing need for improvements in molding systems as well as improvements in their installation and/or fastening means. Applicant's instant invention includes two components which are quickly and easily applied to supported surfaces and a third component which cooperatively engages the first two components with minimal effort. Clearly, none of the above inventions and patents, taken either singly or in combination, is seen to describe the instant invention as claimed.

SUMMARY OF THE INVENTION

The present invention is a molding assembly which includes a length of molding, a pair of retainers, and a plurality of optional L-shaped brackets. The molding assembly is for use in dressing-up a junction or intersection between a wall and a ceiling and to provide an aesthetically pleasing appearance.

The molding shown is shaped in the form of conventional crown molding having yieldable securing members disposed at opposite ends. One yieldable securing member lies in a plane parallel to the wall and the other yieldable securing member lies in a plane parallel to the ceiling. The face of the molding extends diagonally relative to these two parallel planes. The yieldable securing members are formed to include a throat having a reduced area and an enlarged area. The throat is in open communication with an enlarged area. The retainers each include an inwardly and rearwardly directed hook. Successively arranged longitudinal slots are disposed along the entire length of each retainer. The L-shaped brackets have a plurality of through bores passing through each leg thereof. The two legs are connected at one end at a right angle relative to one another. Both the molding and each of the retainers are of substantially equal length. The L-shaped brackets are each dimensioned and configured to retain the shape of the molding.

In one embodiment, the molding assembly is used to mount the molding to both a wall and ceiling. A retainer is secured to both the wall and the ceiling such that the hooks are directed away from the intersection formed therebetween. Each of the retainers are spaced equidistantly from the intersection and the molding is coupled thereto. Each retainer is configured to frictionally engage a respective yieldable member whereby the hooks pass through the throats and enter into the enlarged areas, and are frictionally retained therein.

In an alternative embodiment, the molding assembly is used to mount the molding to a ceiling a predetermined distance away from a wall. A single length of the retainer is secured to the ceiling along with a series of L-shaped brackets. The remaining retainer is attached to a free leg of the L-shaped bracket which extends downward from the ceiling. The molding is coupled with each of the retainers holding the molding a predetermined distance from the wall and against the ceiling. This is an ideal arrangement for concealing lighting fixtures.

In a second alternative embodiment, the molding assembly is used to mount the molding to a wall a predetermined distance away from a ceiling. A single length of the retainer is secured to the wall along with a series of L-shaped brackets. The remaining retainer is attached to a free leg of the L-shaped bracket which extends transversely from the wall. The molding is coupled with each of the retainers holding the molding a predetermined distance from the ceiling and against the wall. This is also an ideal arrangement for concealing lighting fixtures.

The molding assembly is suitable for use indoors and outdoors and may be employed with masonry and wood structures. The same may also be suitable for use with structures having wood or vinyl siding, as well as brick or stucco surfaces.

Accordingly, it is a principal object of the invention to provide a decorative molding assembly for use along the intersection of the walls and ceiling to cover the unsightly, unfinished gaps or defects therebetween and to provide an aesthetically pleasing appearance.

It is another object that the molding assembly be configured so as to easily installed.

It is another object that the molding assembly which is fabricated of synthetic materials.

It is a further object that the installed molding be of a permanent nature and render visible no unsightly fasteners.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1, 2:
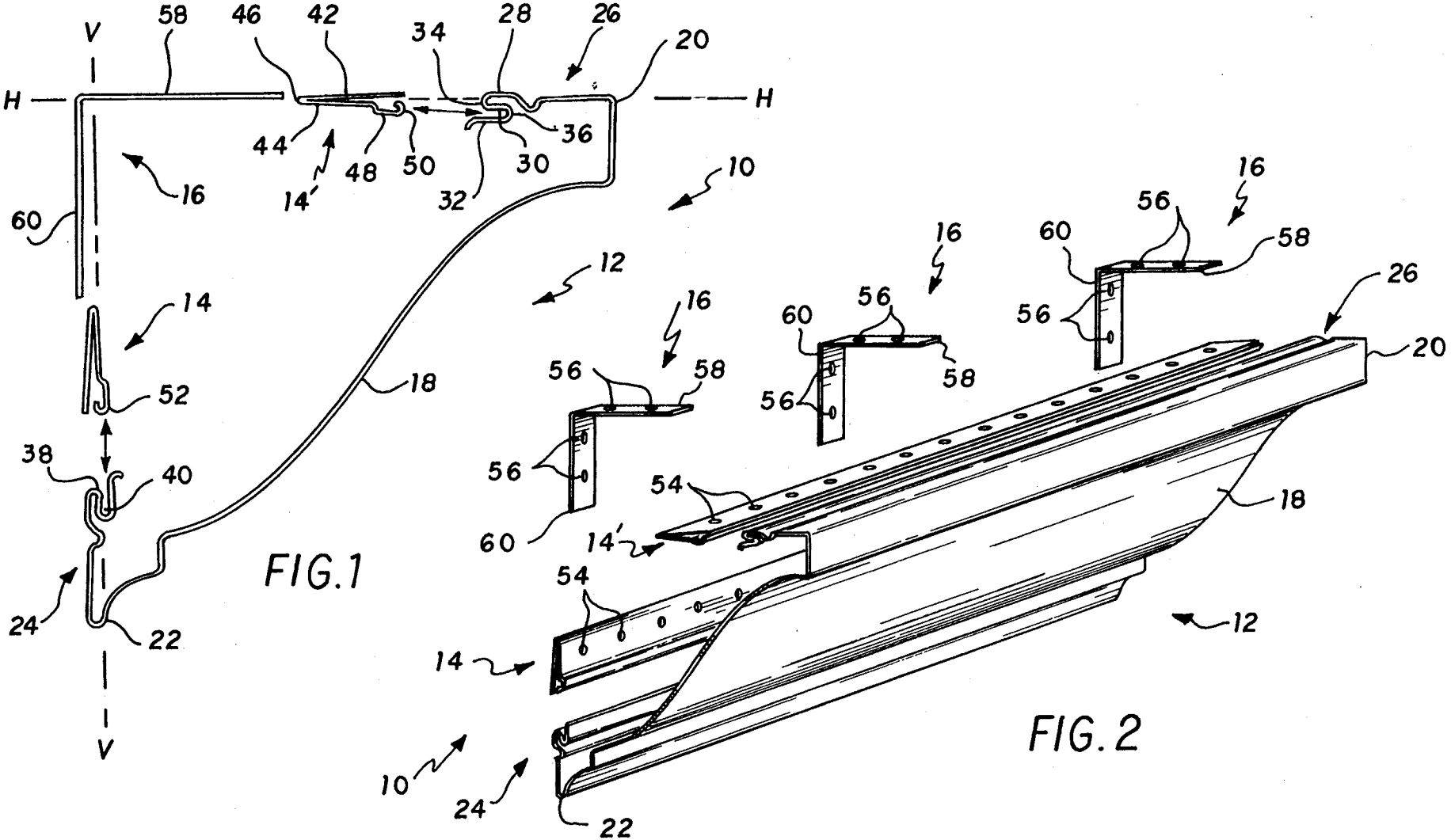
FIG. 1 is an exploded side elevational view of the crown molding assembly according to the present invention.
FIG. 2 is an exploded front perspective view of the crown molding assembly shown in FIG. 1.

The present invention, as shown in FIGS. 1 and 2, is a molding assembly 10 which includes a length of molding 12, a pair of first and second retainers, 14 and 14' respectively, and optional L-shaped brackets 16. The molding assembly 10 is for use in dressing up a junction or intersection between a first surface or a vertical wall W, and a second surface or a ceiling C to conceal unfinished gaps or defects and provide an aesthetically pleasing appearance.

As is clearly shown in FIG. 1, the face 18 of the molding 12 is irregular in shape. The molding 12 shown is shaped in the form of conventional crown molding having a contoured surface and oppositely disposed terminal ends 20, 22. Securing members 24, 26 are integral with the terminal ends 20, 22. A first securing member 24 extends along a horizontal plane H—H and a second yieldable securing member 26 extends along a vertical plane V—V. The face 18 of the molding 12 extends diagonally relative to the horizontal and vertical planes. The molding 12 is preferably fabricated from vinyl material but may be formed from extruded plastic or from metal. The molding 12 should be dimensioned and configured to withstand the normal structural settlement and climatic changes, and should be of suitable thickness to retain its shape or form.

The securing members 24, 26 are symmetrical in configuration. As a result, a description of the first securing member 24 applies also to the second securing member 26. A description of the second securing member 26 separate from that of the first securing member 24 would be redundant and is therefore omitted to simplify the detailed description of the embodiments. The first securing member 24 is formed to include three substantially parallel walls 28, 30, 32 respectively joined together by alternatively disposed, generally semi-circular walls 34, 36. A throat 38 having a reduced area is defined and bounded by walls 30, 32 and an enlarged area 40 is defined and bounded by walls 30, 32, and wall 36. The throat 38 is in open communication with an enlarged area 40. The securing members 24 and 26 are preferably yieldable.

The retainers 14 and 14' are comprised of generally parallel walls 42, 44 integrally joined at one end 46 and generally parallel walls 42, 48 spaced apart at an opposite end 50. The walls 42, 48 at the opposite end 50 are spaced apart by supplementary angles A and B. The end 48 of one of the spaced apart walls 50 is provided with an inwardly and rearwardly directed hook 52. Successively arranged longitudinally along the entire length of each retainer 14 are slots 54. The slots 54 pass through the parallel walls 42, 44 opposite the space walls 42, 48.

The L-shaped brackets 16 are each substantially rigid, preferably of a metal composition. A plurality of through bores 56 passes through each of first and second legs 58, 60 of the L-shaped bracket. The two legs 58, 60 are connected at one end at a right angle relative to one another.

Both the molding 12 and each of the retainers 14 and 14' are of substantially equal length. As an industry standard, most vinyl trim and molding is available in ten foot lengths. It is preferable that the molding 12 and each of the retainers 14 and 14' have a length which complies with the industry standard. Each leg 58, 60 of each L-shaped bracket 16 shown is three inches in length. L-shaped brackets of this type and size are well known.

Figure 3:
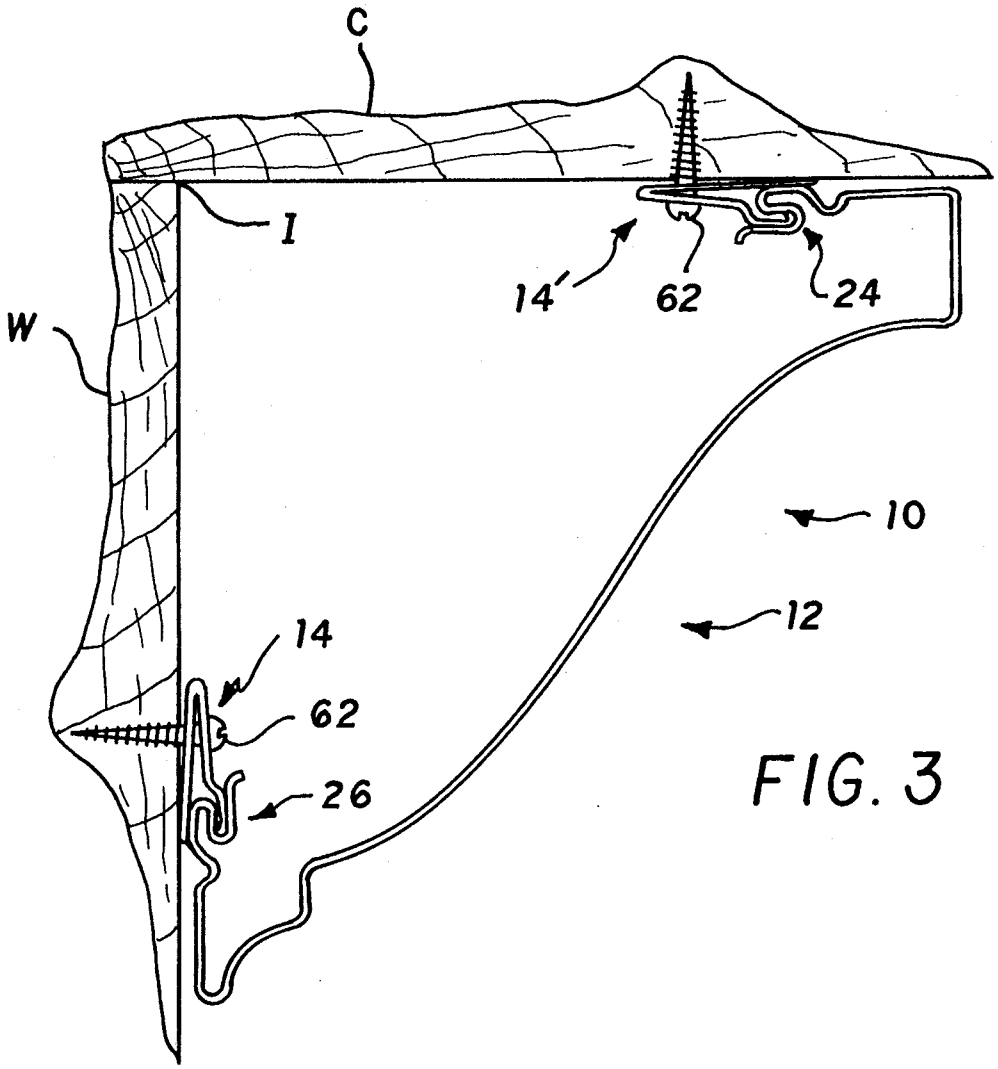
FIG. 3 is a side elevational view of the crown molding installed abutting wall and ceiling surfaces forming a corner.
Figure 4:
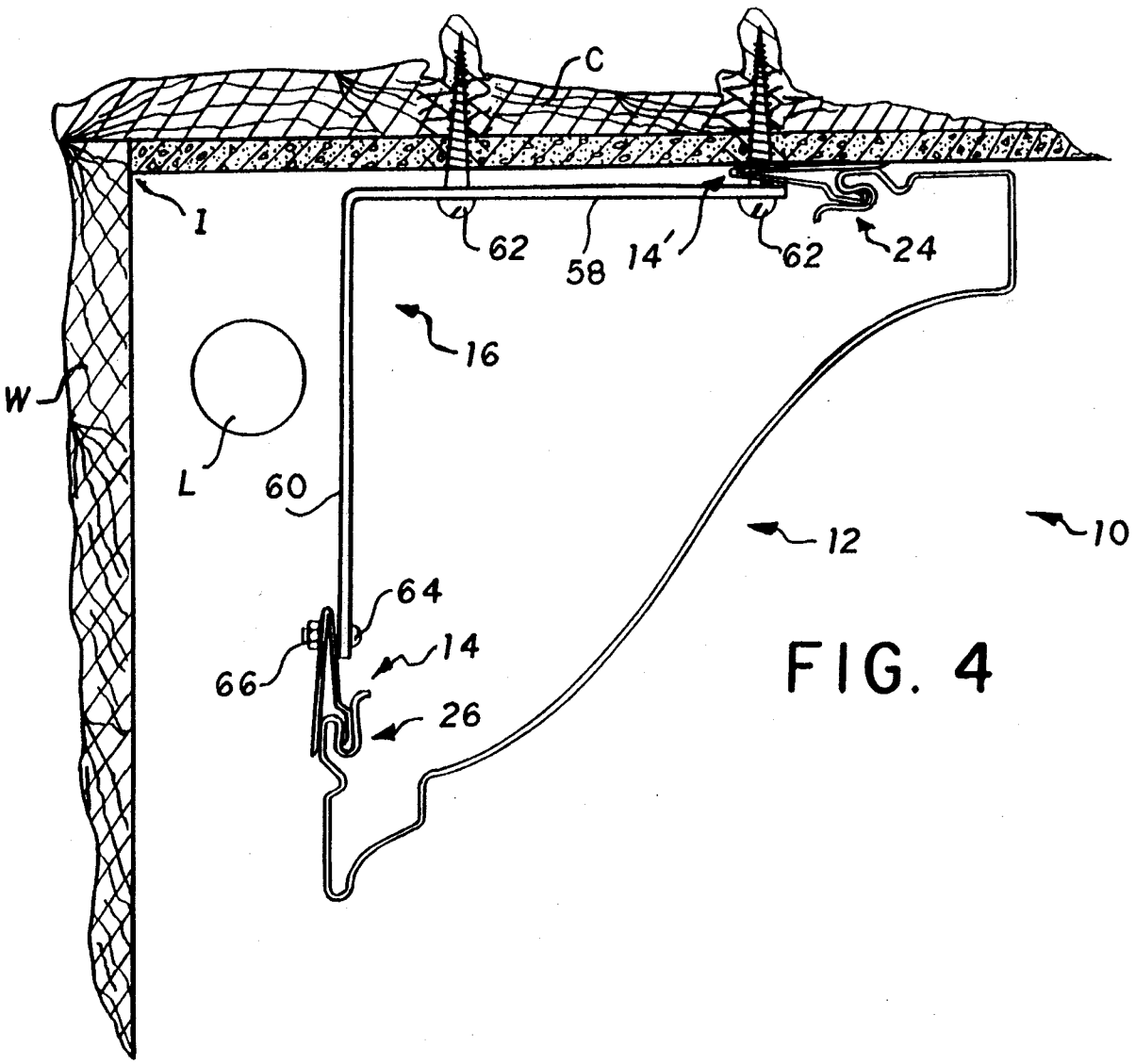
FIG. 4 is a side elevational view of the crown molding installed abutting a ceiling surface.
Figure 5:
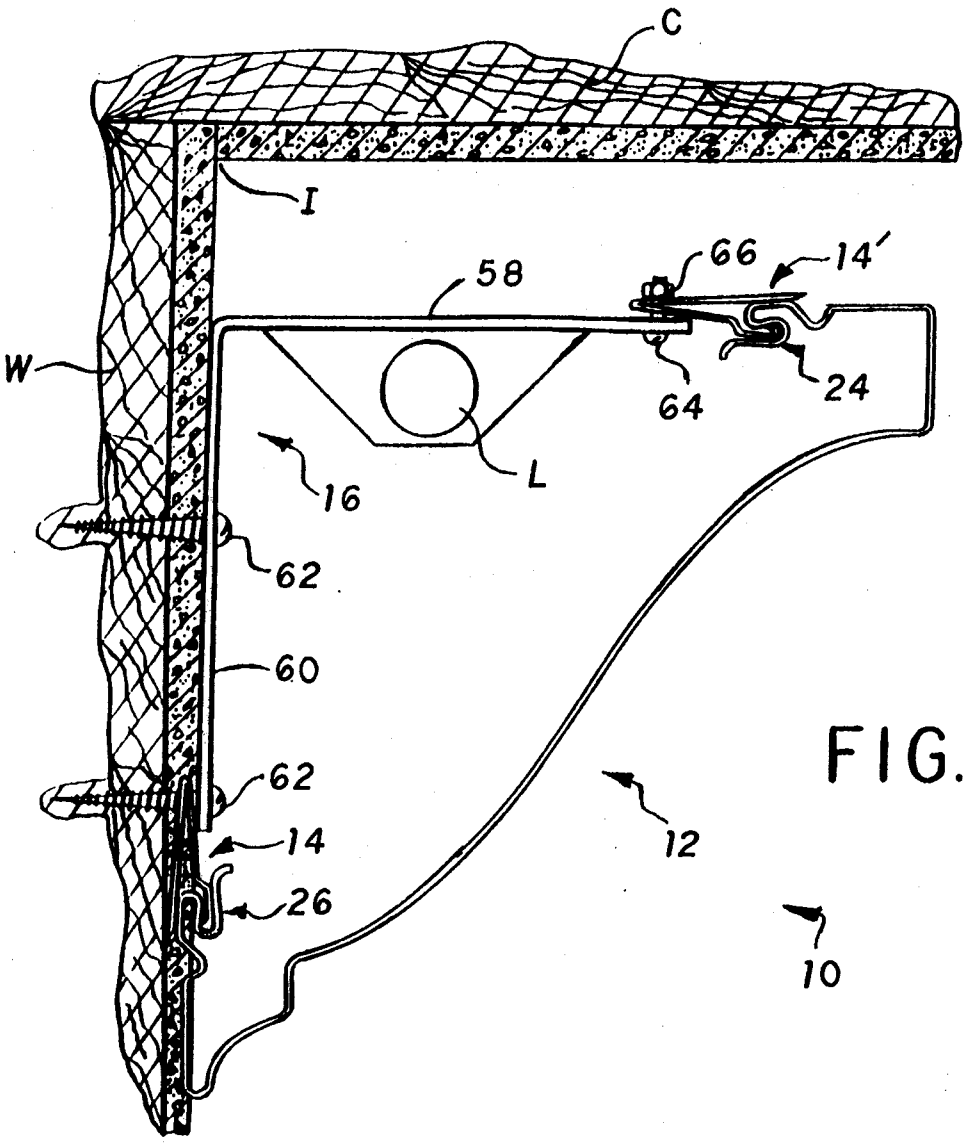
FIG. 5 is a side elevational view of the crown molding installed abutting a wall surface.

FIGS. 3, 4 and 5 show the present invention used in three different arrangements. In the first arrangement, shown in FIG. 3, the molding assembly 10 is used to mount the molding 12 to both a vertical wall W and ceiling C. As shown in FIG. 2, a single length of retainer 14 is first secured to the wall W and a single length of retainer 14' is secured to the ceiling C such that the slots 54 passing through each of the retainers 14 and 14' are disposed closest to the intersection I between the wall W and ceiling C, and the spaced apart walls 42, 48 are directed away from the intersection I.

The fastening of the retainers to their respective surfaces may be accomplished through the use of any suitable fastener. A threaded fastener, such as the screw 62 shown, is preferable. The fasteners 62 should be secured to a part of the building structure, such as the beams B shown, which will provide a durable support for retainers 14 and 14' for the life of the structure. Each of the retainers 14 and 14' is spaced equidistantly from the intersection I of the wall W and ceiling C. In this particular embodiment, one of the retainers 14 is attached to the wall W a constant distance of two and one-half inches over its entire length away from the ceiling C, and the other retainer 14' is attached to the ceiling C a constant distance of two and one-half inches over its entire length away from the wall W. In this way, the molding 12 is coupled with each of the retainers 14 and 14' and the wall W, the ceiling C, and the molding 12 cooperatively form an equilateral triangle.

Each of the retainer 14 and 14' is configured to frictionally engage a respective securing member 24 or 26. More specifically, the inwardly and rearwardly directed hook 52 of each of the retainer 14 and 14' is received by the throat 38 of a respective securing member 24 or 26. The walls 30, 32 of the securing members 24, 26 yield or deflect to permit the passage of the hooks 52, which pass through the throat 38 and enter into the enlarged area 40. After the hooks 52 are received by the respective enlarged areas 40, the walls 30, 32 return to their previous condition, biased against the hooks 52. This frictional engagement between the hooks 52 and the walls 30, 32 maintains the retainers 14 and 14' and their respective securing member 24, 26 in a coupled posture, holding the molding 12 against the wall W and the ceiling C as shown.

In an alternative arrangement, as is shown FIG. 4, the molding assembly 10 is used to mount the molding 12 to a ceiling C a predetermined distance away from the wall W. A single length of the retainer 14' is secured to ceiling C in a manner similar to that described for the aforementioned arrangement. In addition to securing the retainer 14' to the ceiling C, the same threaded fasteners 62 likewise fasten a leg 58 of the L-shaped bracket 16 to the ceiling C. With the retainer 14 and the L-shaped brackets 16 attached to the ceiling C, the retainer 14 is attached to the free leg 60 of the L-shaped bracket 16 extending downwardly, transversely from the ceiling C by fasteners 64, 66, such as the matingly engageable fasteners shown. It is preferable that a nut, a bolt, and washers be used to ensure that the retainer 14 is substantially permanently secured to the free leg 60 of the L-shaped bracket 16. In contrast to the aforementioned embodiment, the retainer 14' and the L-shaped bracket 16 are attached to the ceiling C a predetermined distance from the wall W to enable the molding 12, once coupled to the retainers 14 and 14', to be spaced apart from the wall W. Like the aforementioned embodiment, the molding 12 is coupled with each of the retainers 14 and 14', holding the molding 12 against the ceiling C. As shown, the molding 12 is spaced apart from the wall W a predetermined distance. This is an ideal arrangement for concealing lighting fixtures L.

In a second alternative arrangement, as is shown FIG. 5, the molding assembly 10 is used to mount the molding 12 to a wall W a predetermined distance away from the ceiling C. A single length of the retainer 14 is secured to wall W in a manner similar to that described for the aforementioned arrangements. Similar to the first alternative arrangement, the same threaded fasteners 62 fasten a leg 60 of the L-shaped bracket 16 to the wall W. With the retainer 14 and the L-shaped brackets 16 attached to the wall W, the second retainer 14' is attached to the free leg 58 of the L-shaped bracket 16, extending transversely from the wall W by fasteners 64, 66, such as the matingly engageable fasteners shown. In contrast to the aforementioned embodiments, the retainer 14 and the L-shaped bracket 16 are attached to the wall W a predetermined distance from the ceiling C to enable the molding 12, once coupled to the retainers 14 and 14', to be spaced apart from the ceiling C. Like the aforementioned embodiment, the molding 12 is coupled with each of the retainers 14 and 14', holding the molding 12 against the wall W. The molding 12 is spaced apart from the ceiling C a predetermined distance, thus providing an ideal arrangement for concealing lighting fixtures L.

The molding assembly 10 is suitable for use indoors and outdoors and may be employed with masonry and wood structures. The same may also be suitable for use with structures having wood or vinyl siding, as well as brick or stucco surfaces.

It is to be understood that the present invention is not limited to the embodiments described above, but encompasses any and all embodiments within the scope of the following claims.

I claim:

1. A crown molding assembly comprising:

a first retainer having a first engaging means, said first retainer being securable to a first surface;

a second retainer having a second engaging means, said second retainer being securable to a second surface, said first and second surfaces being conjoined and said second surface lying in a plane substantially perpendicular to said first surface;

a first securing member configured to lie in a plane parallel to said first surface, said first securing member engaging said first engaging means;

a second securing member configured to lie in a plane parallel to said second surface, said second securing member engaging said second engaging means; and a face extending substantially diagonally from said first securing member to said second securing member, said face completely concealing said first and second retainers wherein said first and second securing members are configured to be yieldable, and said first and second engaging means are each frictionally engaging a respective one of said securing members.

2. The crown molding assembly according to claim 1, wherein said securing members each include a throat and an enlarged area, said throat being in open communication with said enlarged area, said throat being yieldable to provide a passage for a respective one of said first and second engaging means.

3. The crown molding assembly according to claim 1, wherein said first and second engaging means each include a hook, said hook frictionally engaging said first and second securing members, respectively.

4. The crown molding assembly according to claim 1, further including at least one bracket having first and second legs, and means for securing said first and second retainers to respective ones of said first and second legs.

5. The crown molding assembly according to claim 4, wherein said first and second legs are joined substantially at a right angle relative to one another.

* * * * *